US008342768B1

(12) United States Patent
Johnston et al.

(10) Patent No.: US 8,342,768 B1
(45) Date of Patent: Jan. 1, 2013

(54) SINK SPRAYER ATTACHMENT APPARATUS

(76) Inventors: Thomas D. Johnston, North Ogden, UT (US); Glenda Johnston, North Ogden, UT (US)

( * ) Notice: Subject to any disclaimer, the term of this patent is extended or adjusted under 35 U.S.C. 154(b) by 297 days.

(21) Appl. No.: 12/781,635

(22) Filed: May 17, 2010

(51) Int. Cl.
*A46B 11/00* (2006.01)
*A46B 11/06* (2006.01)

(52) U.S. Cl. ..... 401/289; 401/290; 401/282

(58) Field of Classification Search ..... 401/134, 401/289, 268, 203, 188 R, 261, 263; 239/310, 239/318, 526; 15/121, 244.1, 236.05
See application file for complete search history.

(56) References Cited

U.S. PATENT DOCUMENTS

| | | | | | |
|---|---|---|---|---|---|
| 2,807,816 | A * | 10/1957 | O'Brien | 401/15 |
| 2,822,559 | A * | 2/1958 | Manville | 401/288 |
| 4,812,070 | A | 3/1989 | Marty | |
| 5,316,401 | A * | 5/1994 | Sears | 401/139 |
| 5,906,319 | A * | 5/1999 | Crowl | 239/310 |
| 6,019,537 | A * | 2/2000 | Hunt | 401/203 |
| 6,035,477 | A | 3/2000 | Robert | |
| 6,092,255 | A * | 7/2000 | Kim | 15/121 |
| 6,152,635 | A * | 11/2000 | Wu | 401/270 |
| 6,178,581 | B1 * | 1/2001 | Lewis | 15/116.2 |
| 6,270,278 | B1 | 8/2001 | Mauro | |
| 6,602,010 | B1 | 8/2003 | Doyle et al. | |
| 6,612,507 | B1 | 9/2003 | Meyer et al. | |
| D515,818 | S | 2/2006 | Groblebe et al. | |
| 7,470,078 | B2 * | 12/2008 | Banco et al. | 401/139 |
| 2007/0071542 | A1 * | 3/2007 | Cicero | 401/290 |
| 2007/0237570 | A1 * | 10/2007 | Lim | 401/279 |
| 2007/0262175 | A1 * | 11/2007 | Fan | 239/525 |

* cited by examiner

*Primary Examiner* — David Walczak
*Assistant Examiner* — Jennifer C Chiang

(57) ABSTRACT

The sink sprayer attachment apparatus is for attachment to an existing hose such as that typically associated with a sink. The spray head fitting is installed on the spray head. Spray head fittings are provided with male and female threads and other forms of attachment to spray heads. The apparatus negates the need for total hose replacement, a feature that saves considerable expense and installation time and effort. The apparatus importantly provides for component disposability, and therefore ideally employs plasticized components and other inexpensive materials.

2 Claims, 4 Drawing Sheets

SINK SPRAYER ATTACHMENT APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The convenience of having attachments for sink sprayers has been established. However, several problems exist with what has been available. One leading problem is that most such devices involve complete sprayer redesign and sprayer and hose replacement, thereby lending greater expense across the board on acquisition and installation of such devices. Another problem is that further added convenience is needed by inclusion of cleaning agent dispersal from such devices, and not all offer such a feature. The present apparatus solves such problems by fitting existing hoses with no alteration required, and by providing positive attachment engagement. The apparatus includes cleaning agent dispensing upon demand, and encourages disposal and replacement of the various heads provided.

FIELD OF THE INVENTION

The sink sprayer attachment apparatus relates to sink sprayers and more especially to a disposable apparatus for existing sink hoses that provides quick positive attachment engagement to the spray head fitting, on-demand cleaning agent dispensing, and more than one attachment.

SUMMARY OF THE INVENTION

The general purpose of the sink sprayer attachment apparatus, described subsequently in greater detail, is to provide a sink sprayer attachment apparatus which has many novel features that result in an improved sink sprayer attachment apparatus which is not anticipated, rendered obvious, suggested, or even implied by prior art, either alone or in combination thereof.

To attain this the sink sprayer attachment apparatus provides for attachment to an existing spray hose typically associated with a sink, thereby saving the cost of hose replacement. The spray head fitting is installed on the apparatus spray head. Spray head fittings are provided with male and female threads and other forms of attachment. The apparatus importantly provides for disposability, and therefore ideally employs plasticized components and other inexpensive materials. A plurality of varied attachments is provided and includes at least a brush with bristles and a sponge. Ideally, each attachment may be fitted with a chamber within which is provided a cleaning agent, such as soap and other typical agents.

The flexible pumps on each attachment provide for a user to selectively pump the agent into the second end of each attachment.

A user can thereby choose whether or not to use the cleaning agent. As the attachments are designed to be disposed of, a user can do so and simply insert a new attachment onto the spray head fitting, with only a quarter turn needed to secure each attachment. Importantly, the abutment allows the annular end of the spray head fitting to form a water tight seal, thereby solving the problems of water leakage associated with previous attachment devices. With each attachment, chambers surround the passages from the cylinder to the outlets so that water does not pass through the agent chambers.

Thus has been broadly outlined the more important features of the improved sink sprayer attachment apparatus so that the detailed description thereof that follows may be better understood and in order that the present contribution to the art may be better appreciated.

An object of the sink sprayer attachment apparatus is to provide convenient cleaning attachments.

Another object of the sink sprayer attachment apparatus is to require no hose replacement.

A further object of the sink sprayer attachment apparatus is to provide more than one spray head attachment.

An added object of the sink sprayer attachment apparatus is to provide for positive, quick engagement of attachments with the spray head.

And, an object of the sink sprayer attachment apparatus is to provide on-demand cleaning agent dispensing from the attachments.

Yet another object of the sink sprayer attachment apparatus is to provide inexpensive, disposable sprayer attachments.

These together with additional objects, features and advantages of the improved sink sprayer attachment apparatus will be readily apparent to those of ordinary skill in the art upon reading the following detailed description of presently preferred, but nonetheless illustrative, embodiments of the improved sink sprayer attachment apparatus when taken in conjunction with the accompanying drawings.

In this respect, before explaining the current embodiments of the improved sink sprayer attachment apparatus in detail, it is to be understood that the sink sprayer attachment apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved sink sprayer attachment apparatus. It is therefore important that the claims be regarded as including such equivalent constructions insofar as they do not depart from the spirit and scope of the sink sprayer attachment apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 7 thereof, the principles and concepts of the sink sprayer attachment apparatus generally designated by the reference number 10 will be described.

Figure 1:
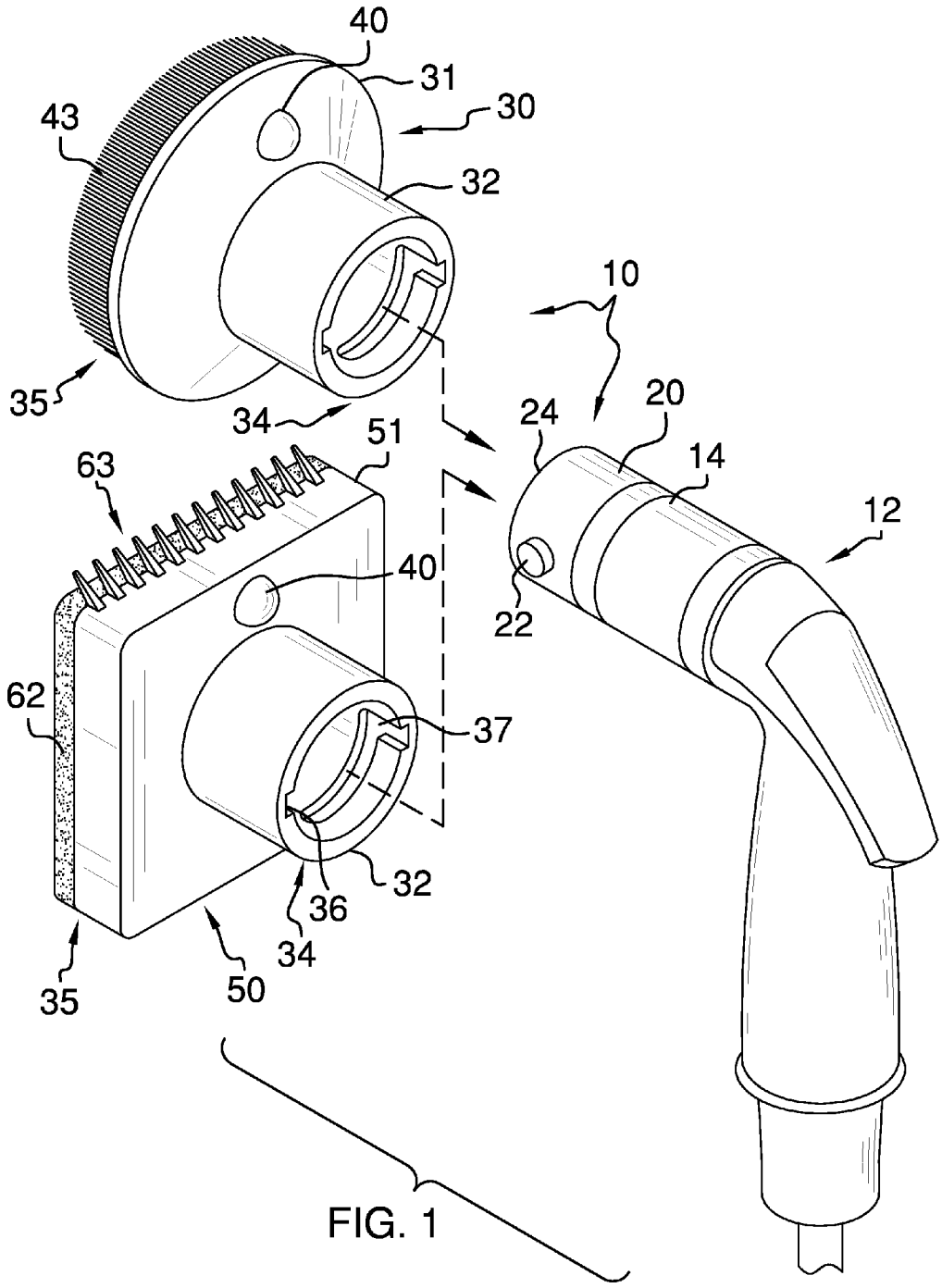
FIG. 1 is a perspective view.

Referring to FIG. 1, the apparatus 10 partially comprises the cylindrical spray head fitting 20 fitted to the spray head 14 of the sprayer 12, the sprayer 12 attached to an existing hose. The pair of diametrically opposed lock tabs 22 is disposed exteriorly on the spray head fitting 20. The annular end 24 is disposed on the spray head fitting 20. The pair of attachments is removably fitted to the spray head fitting 20. The attachments comprise the first attachment 30 and the second attachment 50. Each attachment has a first end 34 spaced apart from a second end 35.

Figure 3:
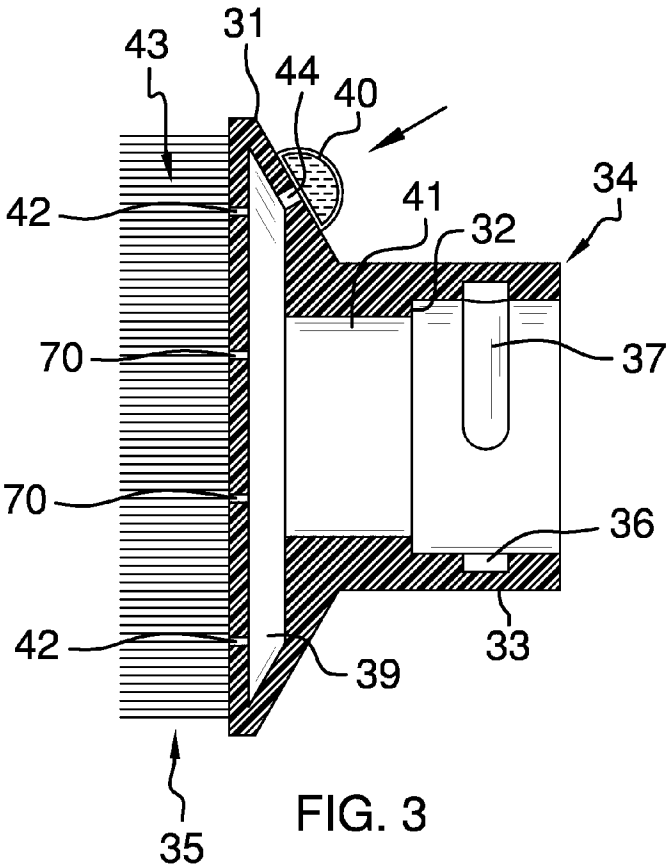
FIG. 3 is a cross sectional view of FIG. 2, taken along the line 3-3.
Figure 6:
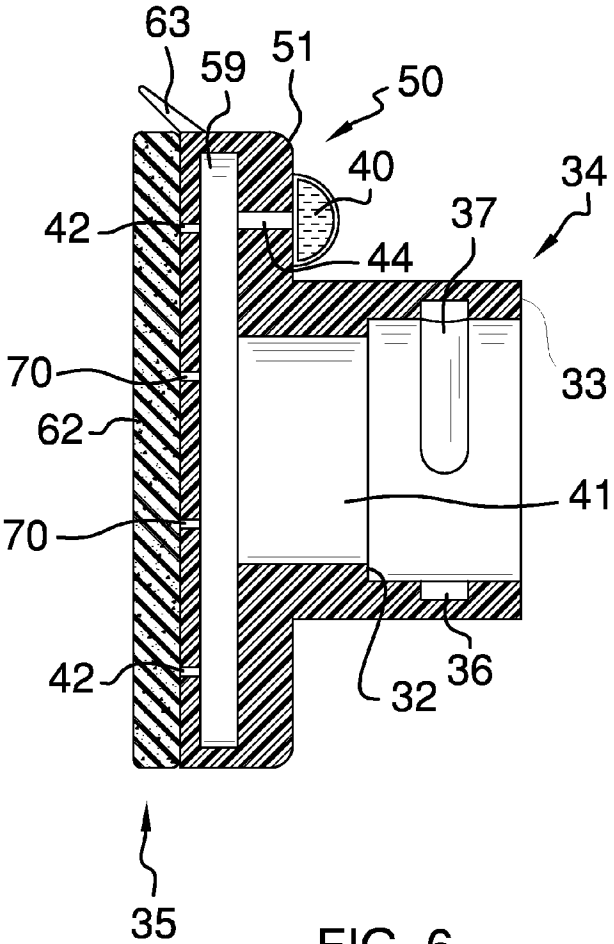
FIG. 6 is a cross sectional view of FIG. 5, taken along the line 6-6.

Referring to FIGS. 3 and 6, a cylinder 33 is disposed within the first end 34 of each attachment. A pair of opposed locking grooves is diametrically disposed within each cylinder 33.

The locking grooves are in removable receipt of the lock tabs 22 of the spray head fitting 20. The locking grooves provide for the attachments to fit the spray head fitting 20 via only a quarter turn. The locking grooves comprise the first quarter turn locking groove 36 and the second quarter turn locking groove 37. An abutment 32 is disposed medially within each cylinder 33. The abutment 32 is in firm removable water tight receipt of the spray head fitting 20 annular end 24. A passage 41 is extended from each cylinder 33. The passage 41 is extended from the abutment 32 toward the second end 35.

Figure 2:
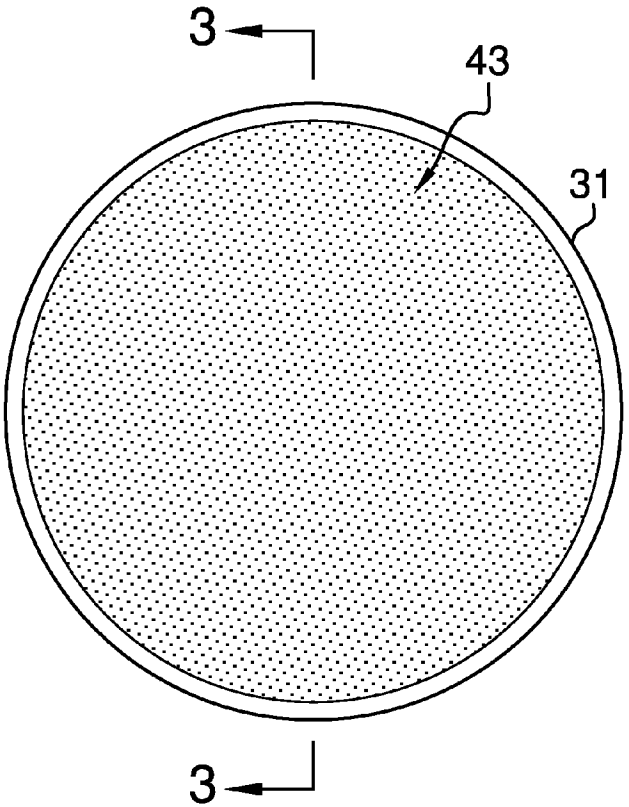
FIG. 2 is a second end view of the first attachment.

Referring to FIGS. 2 and 3, the first attachment 30 further comprises a circular head 31. A plurality of water outlets 70 is disposed within the circular head 31. The water outlets 70 connect the passage 41 to the second end 35. A ring chamber 39 is disposed within the circular head 31 and laterally outside of the passage 41. A flexible pump 40 is disposed medially on the circular head 31. The flexible pump 40 is in communication with the ring chamber 39 via the transfer 44.

Figure 4:
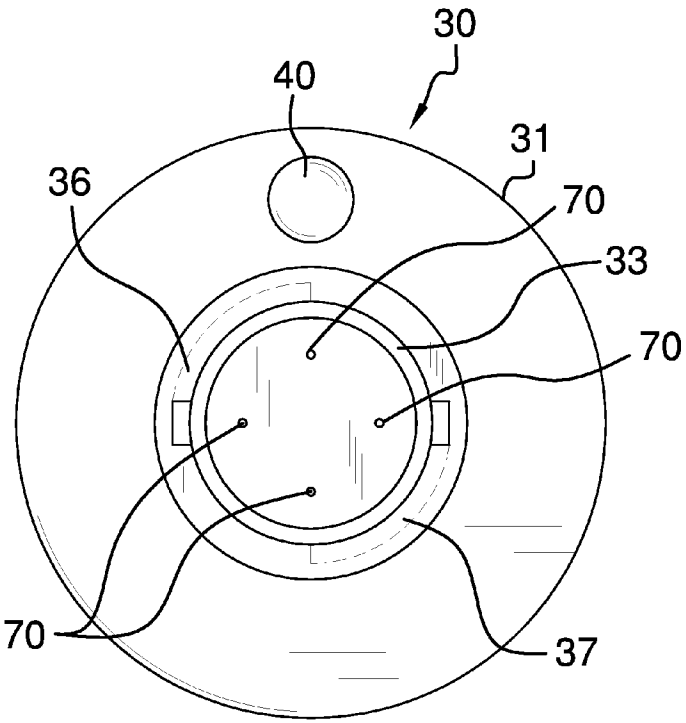
FIG. 4 is a first end view of the first attachment.

Referring again to FIGS. 2 and 3 and also to FIG. 4, a plurality of spaced apart outlets 42 is disposed within the circular head 31. The outlets 42 connect to the ring chamber 39. The plurality of bristles 43 is disposed on the first attachment 30 first end 34. The bristles 43 are in communication with the water outlets 70 and the outlets 42.

Figure 7:
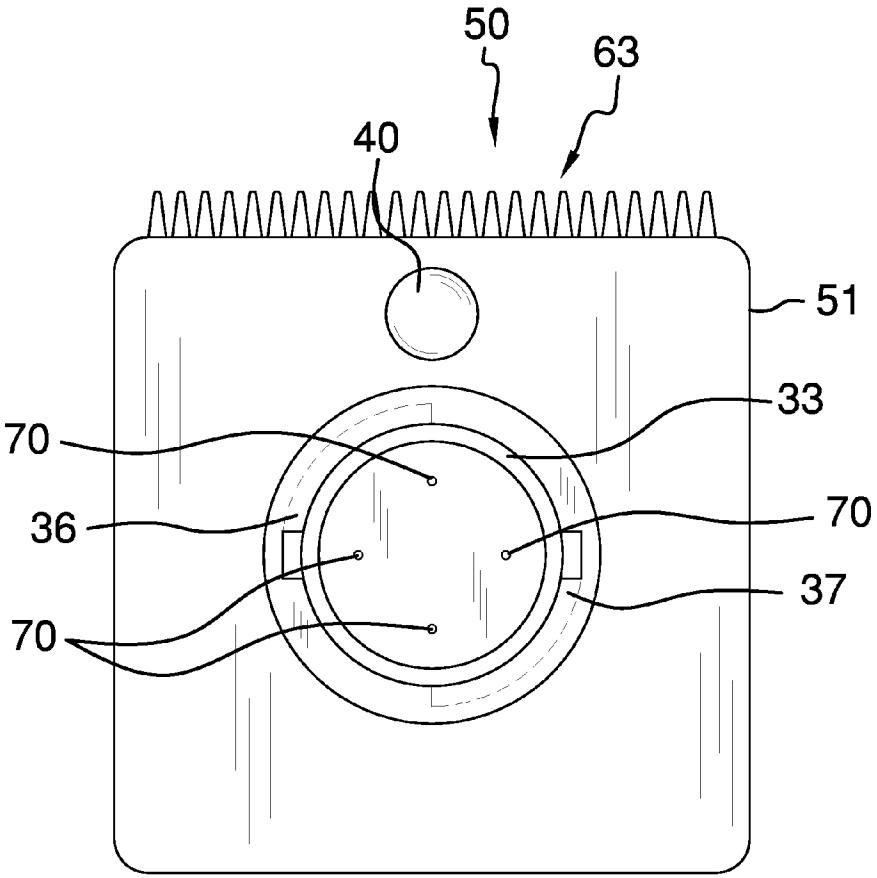
FIG. 7 is an attachment first end view of the second attachment.

Referring to FIGS. 6 and 7, the second attachment 50 further comprises the rectangular head 51. A plurality of water outlets 70 is disposed within the rectangular head 51. The water outlets 70 connect the passage 41 to the second end 35.

The rectangular chamber 59 is disposed within the rectangular head 51 and laterally outside of the passage 41. The flexible pump 40 is disposed medially on the rectangular head 51. The flexible pump 40 is in communication with the rectangular chamber 59 via the transfer 44. A plurality of spaced apart outlets 42 is disposed within the rectangular head 51. The outlets 42 connect to the rectangular chamber 59. The sponge 62 is disposed outwardly on the rectangular head 51. The sponge 62 is in communication with the water outlets 70 and the outlets 42.

Figure 5:
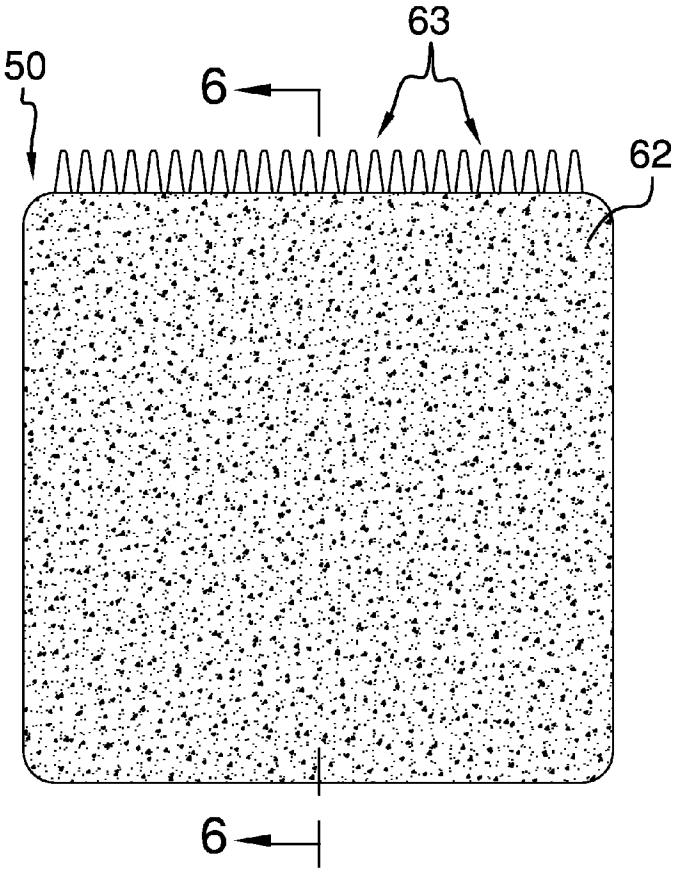
FIG. 5 is a second end view of the second attachment.

Referring to FIG. 5, the plurality of scraping fingers 63 is disposed angularly outward atop the rectangular head 51.

With respect to the above description then, it is to be realized that the optimum dimensional relationships for the parts of the sink sprayer attachment apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the sink sprayer attachment apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the sink sprayer attachment apparatus may be used.

Therefore, the foregoing is considered as illustrative only of the principles of the sink sprayer attachment apparatus. Further, since numerous modifications and changes will readily occur to those skilled in the art, it is not desired to limit the sink sprayer attachment apparatus to the exact construction and operation shown and described, and accordingly, all suitable modifications and equivalents may be resorted to, falling within the scope of the sink sprayer attachment apparatus.

What is claimed is:

1. A sink sprayer attachment apparatus comprising, in combination:

a sprayer fitted to an existing hose, the sprayer partially comprising:
- a cylindrical spray head;
- a spray head fitting fitted to the spray head;

a pair of diametrically opposed lock tabs disposed exteriorly on the spray head fitting;

an annular end disposed on the spray head fitting;

a pair of attachments removably fitted to the spray head fitting, the attachments comprising a first attachment and a second attachment, each attachment having a first end spaced apart from a second end;

a cylinder disposed within the first end of each attachment;

a pair of opposed locking grooves diametrically disposed within each cylinder, the locking grooves in removable receipt of the lock tabs of the spray head fitting, the locking grooves comprising a first quarter turn locking groove and a second quarter turn locking groove;

an abutment disposed medially within each cylinder, the abutment in firm, water tight, removable receipt of the spray head fitting annular end;

a passage extended from each cylinder, the passage extended from the abutment toward the second end;

the first attachment further comprising:
- a circular head;
- a plurality of water outlets disposed within the circular head, the water outlets connecting the passage to the second end;
- a plurality of bristles disposed on the first attachment first end, the bristles in communication with the water outlets;

the second attachment further comprising:
- a rectangular head;
- a plurality of water outlets disposed within the rectangular head, the water outlets connecting the passage to the second end;
- a sponge disposed outwardly on the rectangular head, the sponge in communication with the water outlets;
- a plurality of scraping fingers disposed angularly outward atop the rectangular head.

2. A sink sprayer attachment apparatus comprising, in combination:

a sprayer fitted to an existing hose, the sprayer partially comprising:

a cylindrical spray head;

a spray head fitting fitted to the spray head;

a pair of diametrically opposed lock tabs disposed exteriorly on the spray head fitting;

an annular end disposed on the spray head fitting;

a pair of attachments removably fitted to the spray head fitting, the attachments comprising a first attachment and a second attachment, each attachment having a first end spaced apart from a second end;

a cylinder disposed within the first end of each attachment;

a pair of opposed locking grooves diametrically disposed within each cylinder, the locking grooves in removable receipt of the lock tabs of the spray head fitting, the locking grooves comprising a first quarter turn locking groove and a second quarter turn locking groove;

an abutment disposed medially within each cylinder, the abutment in firm, water tight, removable receipt of the spray head fitting annular end;

a passage extended from each cylinder, the passage extended from the abutment toward the second end;

the first attachment further comprising:

a circular head;

a plurality of water outlets disposed within the circular head, the water outlets connecting the passage to the second end;

a ring chamber disposed within the circular head and laterally outside of the passage;

a flexible pump disposed medially on the circular head, the flexible pump in communication with the ring chamber via a transfer;

a plurality of spaced apart outlets disposed within the circular head, the outlets connected to the ring chamber;

a plurality of bristles disposed on the first attachment first end, the bristles in communication with the water outlets and the outlets;

the second attachment further comprising:

a rectangular head;

a plurality of water outlets disposed within the rectangular head, the water outlets connecting the passage to the second end;

a rectangular chamber disposed within the rectangular head and laterally outside of the passage;

a flexible pump disposed medially on the rectangular head, the flexible pump in communication with the rectangular chamber via a transfer;

a plurality of spaced apart outlets disposed within the rectangular head, the outlets connected to the rectangular chamber;

a sponge disposed outwardly on the rectangular head, the sponge in communication with the water outlets and the outlets;

a plurality of scraping fingers disposed angularly outward atop the rectangular head.

* * * * *